US011495397B2

(12) United States Patent
Matsunaga

(10) Patent No.: US 11,495,397 B2
(45) Date of Patent: Nov. 8, 2022

(54) COIL COMPONENT

(71) Applicant: Murata Manufacturing Co., Ltd., Kyoto-fu (JP)

(72) Inventor: Minoru Matsunaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 408 days.

(21) Appl. No.: 16/788,471

(22) Filed: Feb. 12, 2020

(65) Prior Publication Data

US 2020/0265994 A1 Aug. 20, 2020

(30) Foreign Application Priority Data

Feb. 20, 2019 (JP) ..... JP2019-028422

(51) Int. Cl.

| | |
|---|---|
| ***H01F 27/32*** | (2006.01) |
| ***H01F 27/28*** | (2006.01) |
| ***H01F 41/12*** | (2006.01) |
| *H01F 27/29* | (2006.01) |

(52) U.S. Cl.

CPC ..... *H01F 27/323* (2013.01); *H01F 27/2804* (2013.01); *H01F 41/122* (2013.01); *H01F 27/29* (2013.01); *H01F 2027/2809* (2013.01)

(58) Field of Classification Search

CPC .. H01F 27/323; H01F 27/2804; H01F 41/122; H01F 27/29; H01F 2027/2809

See application file for complete search history.

(56) References Cited

U.S. PATENT DOCUMENTS

| | | | | |
|---|---|---|---|---|
| 2012/0024582 | A1 | 2/2012 | Maeda et al. | |
| 2015/0245473 | A1* | 8/2015 | Shimizu ..... | H05K 1/113 29/850 |
| 2018/0012698 | A1 | 1/2018 | Nakatsuji et al. | |

FOREIGN PATENT DOCUMENTS

| | | | |
|---|---|---|---|
| CN | 102347287 | A | 2/2012 |
| CN | 107591235 | A | 1/2018 |
| JP | H09-17634 | A | 1/1997 |
| JP | 2006-210579 | A | 8/2006 |
| JP | 2013-161939 | A | 8/2013 |
| JP | 2014-127718 | A | 7/2014 |
| JP | 2015-012022 | A | 1/2015 |

OTHER PUBLICATIONS

An Office Action; "Notice of Reasons for Refusal," mailed by the Japanese Patent Office dated Nov. 2, 2021, which corresponds to Japanese Patent Application No. 2019-028422 and is related to U.S. Appl. No. 16/788,471 with English translation.

* cited by examiner

*Primary Examiner* — Dinh T Le

(74) *Attorney, Agent, or Firm* — Studebaker & Brackett PC

(57) ABSTRACT

A coil component includes a multilayer body in which a plurality of resin insulating layers are laminated in a lamination direction and coil conductive layers disposed inside the multilayer body. The plurality of resin insulating layers includes non-photosensitive first resin insulating layers and photosensitive second resin insulating layers. The multilayer body has a section where the first resin insulating layers and the second resin insulating layers are alternately laminated.

17 Claims, 5 Drawing Sheets

COIL COMPONENT

CROSS-REFERENCE TO RELATED APPLICATION

This application claims benefit of priority to Japanese Patent Application No. 2019-028422, filed Feb. 20, 2019, the entire content of which is incorporated herein by reference.

BACKGROUND

Technical Field

The present disclosure relates to coil components.

Background Art

Electronic components are incorporated in various electronic devices. One known example of the electronic components is a multilayer-type coil component as described, for example, in Japanese Unexamined Patent Application Publication No. 2014-127718. The multilayer-type coil component includes a multilayer body in which a plurality of insulating layers are laminated and coil conductive layers disposed inside the multilayer body.

In the above-described coil component, an internal defect, such as a crack, may occur. Typically, each of the insulating layers used in the above-described coil component has a coefficient of linear expansion different from that of each of the coil conductive layers. Thus, stress is accumulated by heat load exerted in a producing process and a mounting process, and this may cause an internal defect, such as a crack. In particular, such an internal defect is likely to occur when the insulating layer is a resin insulating layer, which is made of a resin. This is because a photosensitive resin insulating layer that has a significantly larger coefficient of linear expansion than that of the coil conductive layer is commonly used as the resin insulating layer, and a large amount of stress is accumulated in the resin insulating layer.

SUMMARY

Accordingly, the present disclosure provides a coil component in which the occurrence of internal defects can be suppressed.

According to preferred embodiments of the present disclosure, a coil component includes a multilayer body in which a plurality of resin insulating layers are laminated in a lamination direction and a first coil conductive layer disposed inside the multilayer body. The multilayer body includes a non-photosensitive first resin insulating layer and a photosensitive second resin insulating layer and has a section where the first resin insulating layer and the second resin insulating layer are alternately laminated.

In this configuration, the stress in the second resin insulating layer, which has a larger coefficient of linear expansion, can be easily released in the section where the first resin insulating layer and the second resin insulating layer are alternately laminated, and thus the occurrence of internal defects, such as cracks, can be suppressed.

According to preferred embodiments of the present disclosure, a coil component includes a multilayer body in which a plurality of resin insulating layers are laminated in a lamination direction and a first coil conductive layer disposed inside the multilayer body. The multilayer body includes a first resin insulating layer and a second resin insulating layer having a coefficient of linear expansion larger than that of the first resin insulating layer and has a section where the first resin insulating layer and the second resin insulating layer are alternately laminated.

In this configuration, the stress in the second resin insulating layer, which has the larger coefficient of linear expansion, can be easily released in the section where the first resin insulating layer and the second resin insulating layer are alternately laminated, and thus the occurrence of internal defects, such as crack(s), can be suppressed.

The preferred embodiments of the present disclosure can provide the coil component in which the occurrence of internal defects can be suppressed.

Other features, elements, characteristics and advantages of the present disclosure will become more apparent from the following detailed description of preferred embodiments of the present disclosure with reference to the attached drawings.

DETAILED DESCRIPTION

Embodiments are described below.

The accompanying drawings may illustrate elements in an enlarged manner for facilitating the understanding. The dimensional ratios of the elements may differ from the real ones or the ones in other drawings. In the cross-sectional views and plan views, in which hatching and patterns are applied for facilitating the understanding, some elements may not be hatched or patterned.

First Embodiment

A first embodiment is described below.

Figure 1:
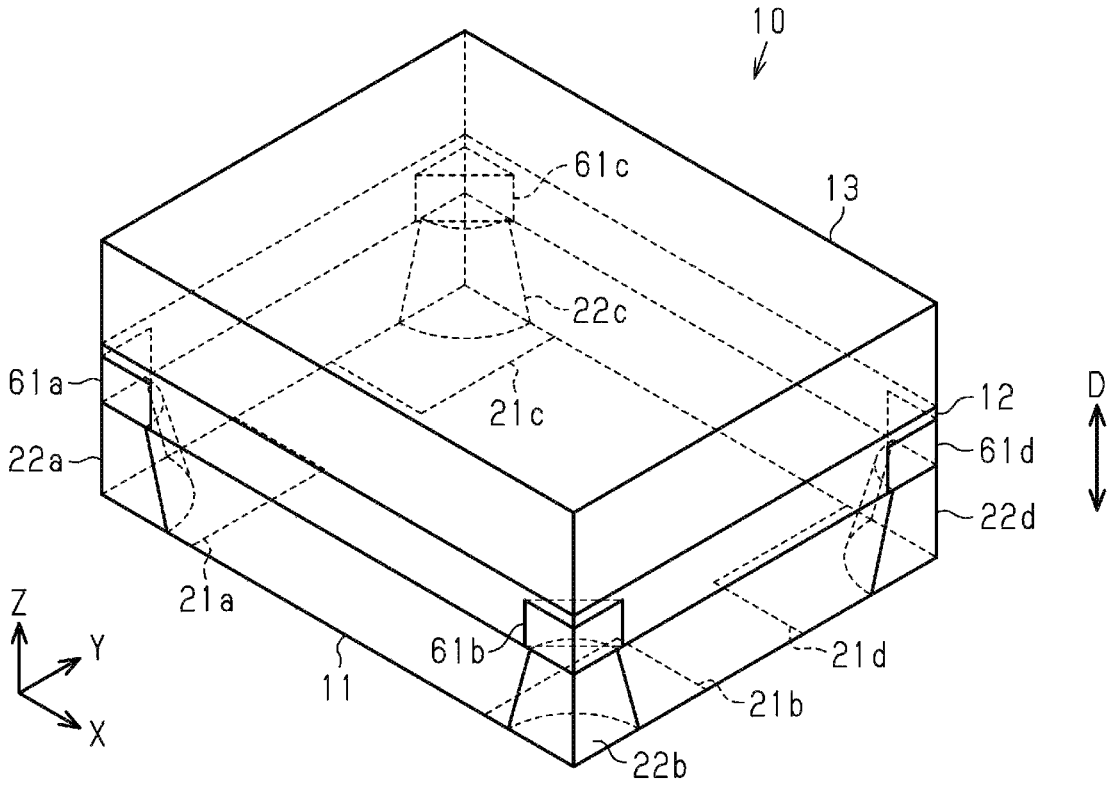
FIG. 1 is a schematic perspective view that illustrates an external appearance of a coil component according to a first embodiment.
Figure 2:
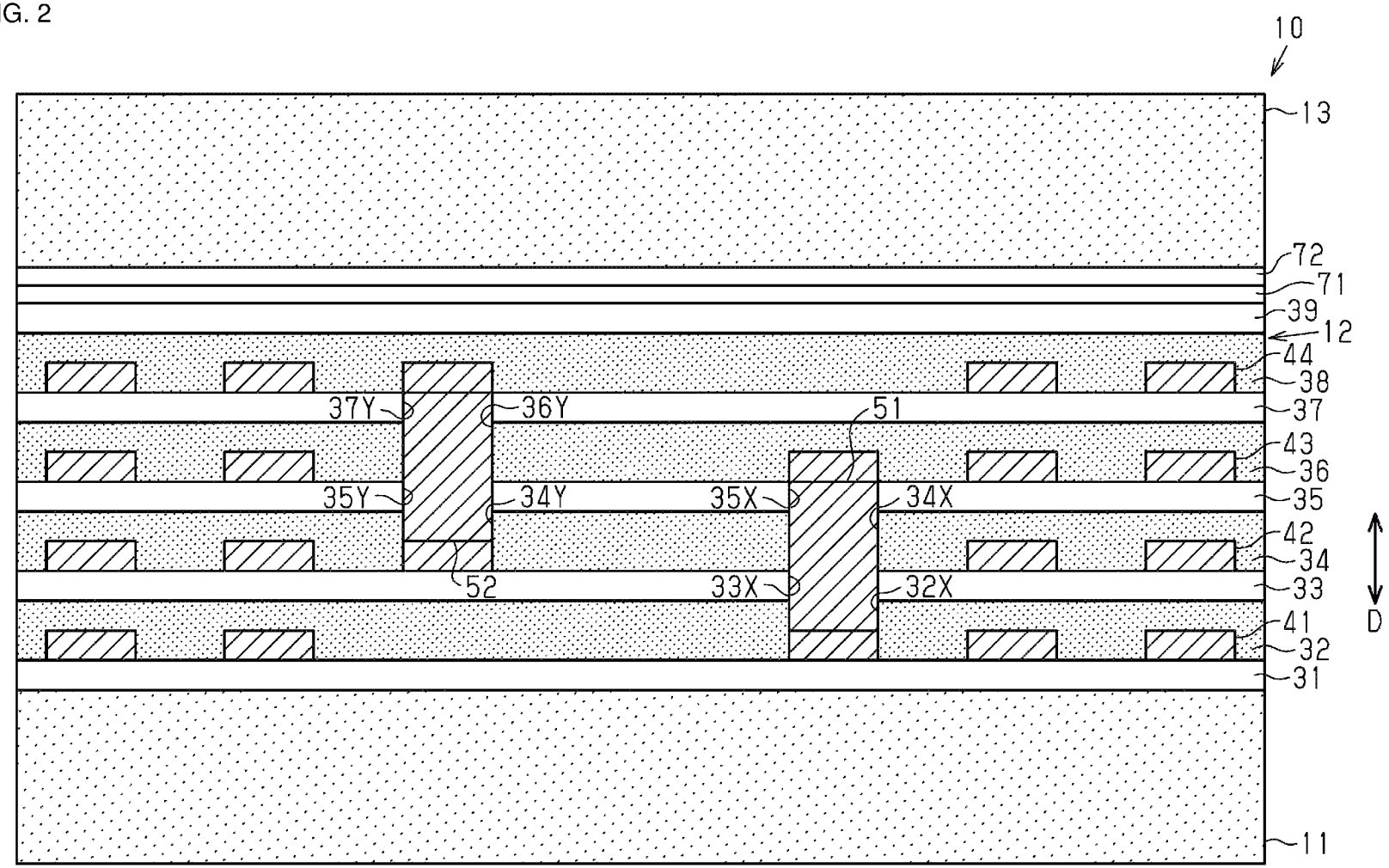
FIG. 2 is a schematic cross-sectional view that illustrates the coil component according to the first embodiment.

As illustrated in FIG. 1, a coil component 10 has a substantially rectangular parallelepiped shape. As illustrated in FIG. 2, the coil component 10 includes a multilayer body 12 in which a plurality of resin insulating layers 31 to 39 are laminated in a lamination direction D and coil conductive layers 41 to 44 inside the multilayer body 12. The resin insulating layers 31, 33, 35, 37, and 39 are non-photosensitive first resin insulating layers. The resin insulating layers 32, 34, 36, and 38 are photosensitive second resin insulating layers. The multilayer body 12 has a section where the first resin insulating layers and the second resin insulating layers are alternately laminated.

In FIG. 1, a direction substantially parallel with the lamination direction D in the coil component 10 is defined as a z-axis direction, and as viewed from the z-axis direction, a direction in which the longer sides of the coil component 10 extend is defined as an x-axis direction and a direction in which the shorter sides of the coil component 10 extend is defined as a y-axis direction. In the z-axis direction, a side where external terminals 21*a* to 21*d* in the coil component 10 are present is defined as the lower side, and a side opposite thereto is defined as the upper side.

A first substrate 11 and a second substrate 13 are disposed on opposite surfaces of the multilayer body 12 in the lamination direction D. In the present embodiment, the first substrate 11 is disposed on the lower surface of the multilayer body 12, and the second substrate 13 is disposed on the upper surface of the multilayer body 12.

The first substrate 11 has a substantially rectangular parallelepiped shape. The first substrate 11 may be made of, for example, a non-resin. In the present embodiment, the first substrate 11 is made of a magnetic material. The first substrate 11 may be, for example, a ferrite sinter. The first substrate 11 may also be a resinous molding that contains magnetic powder. Examples of the magnetic powder may include ferrite and magnetic metal materials, including iron, silicon, and chromium. An example of the resin material may be an epoxy resin. When the first substrate 11 is a resin that contains magnetic powder, it may be preferred that the resin have a mixture of two or three kinds of magnetic powder having different granular variations because such magnetic powder can be moderately distributed with ease.

The external terminals 21*a* to 21*d* are disposed on the corner portions of the bottom surface of the first substrate 11. Each of the external terminals 21*a* to 21*d* has a substantially rectangular shape when the coil component 10 is viewed from the lower side. The external terminals 21*a* to 21*d* are connected by soldering or the like to land patterns on a mounting substrate on which the coil component 10 is mounted. The external terminals 21*a* to 21*d* may be formed of a metal layer made of, for example, gold, nickel, copper, titanium, or silver by, for example, plating, sputtering, vapor deposition, or printing. The external terminals 21*a* to 21*d* may have a multilayer structure in which a plating layer made of, for example, nickel or tin is formed on a base layer made of, for example, copper.

Connection members 22*a* to 22*d* are disposed in the corner portions of the first substrate 11. The connection members 22*a* to 22*d* are connected to the external terminals 21*a* to 21*d*, respectively, at their bottoms. An example material of the connection members 22*a* to 22*d* and an example method for forming them may be the same as the ones exemplified in the description on the external terminals 21*a* to 21*d*. The connection members 22*a* to 22*d* may be formed integrally with or independently of the external terminals 21*a* to 21*d*.

As illustrated in FIG. 2, the coil conductive layers 41 and 43 are electrically connected to each other by a via wire 51 extending through the resin insulating layers 32 to 35 along the lamination direction D on their inner end sides of their two-dimensional helical shapes, and the coil conductive layers 42 and 44 are electrically connected to each other by a via wire 52 extending through the resin insulating layers 34 to 37 along the lamination direction D on their inner end sides of their two-dimensional helical shapes. The via wire 51 is a conductor disposed in opening portions 32X, 33X, 34X, and 35X of the resin insulating layers 32, 33, 34, and 35. The via wire 52 is a conductor disposed in opening portions 34Y, 35Y, 36Y, and 37Y of the resin insulating layers 34, 35, 36, and 37.

As illustrated in FIG. 1, connection members 61*a* to 61*d* exposed from the corner portions of the multilayer body 12 are disposed in the multilayer body 12. The connection members 61*a* to 61*d* are also exposed on the lower-surface side of the multilayer body 12 and are electrically connected to the connection members 22*a* to 22*d*. An example material of the coil conductive layers 41 to 44, via wires 51 and 52, and connection members 61*a* to 61*d* and an example method for forming them may be the same as the ones exemplified in the description on the external terminals 21*a* to 21*d*. The thickness of each of the coil conductive layers 41 to 44 may preferably be not less than about 1 μm and not more than about 100 μm (i.e., from about 1 μm to about 100 μm), may more preferably be not less than about 5 μm and not more than about 20 μm (i.e., from about 5 μm to about 20 μm), and an example of that thickness may be about 15 μm.

Each of the coil conductive layers 41 to 44 is electrically connected to one of the connection members 61*a* to 61*d* on its outer end side of its two-dimensional helical shape. Thus, the coil conductive layers 41 to 44 are electrically connected to the external terminals 21*a* to 21*d*.

Figure 4:
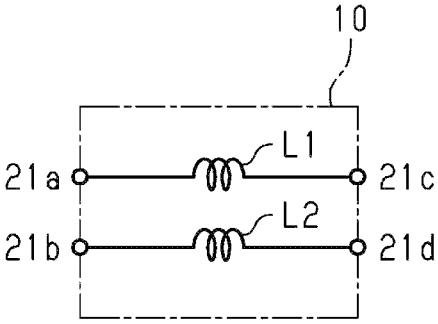
FIG. 4 is a circuit diagram of the coil component according to the first embodiment.

As illustrated in FIG. 4, the coil component 10 according to the present embodiment includes a first coil L1 and a second coil L2. The first coil L1 is connected between the external terminals 21*a* and 21*c*. The second coil L2 is connected between the external terminals 21*b* and 21*d*.

The details are below. As illustrated in FIGS. 1 and 2, the first coil L1 is composed of the coil conductive layers 41 and 43 and via wire 51. Accordingly, in the coil component 10, the external terminal 21*a*, the connection members 22*a* and 61*a*, the outer end of the coil conductive layer 41, the inner end of the coil conductive layer 41, the via wire 51, the inner end of the coil conductive layer 43, the outer end of the coil conductive layer 43, the connection members 61*c* and 22*c*, and the external terminal 21*c* are electrically connected in series in this order. Similarly, the second coil L2 is composed of the coil conductive layers 42 and 44 and via wire 52. Accordingly, in the coil component 10, the external terminal 21*b*, the connection members 22*b* and 61*b*, the outer end of the coil conductive layer 42, the inner end of the coil conductive layer 42, the via wire 52, the inner end of the coil conductive layer 44, the outer end of the coil conductive layer 44, the connection members 61*d* and 22*d*, and the external terminal 21*d* are electrically connected in series in this order. The coil connection configuration is not limited to the above-described one. For example, it may be a configuration in which the coil conductive layers 41 and 44 are connected by the via wire 51, and the coil conductive layers 42 and 43 are connected by the via wire 52. Another example may be a configuration in which the coil conductive layers 41 and 42 are connected by the via wire 51 and the coil conductive layers 43 and 44 are connected by the via wire 52.

One example case where the coil component 10 is a common-mode choke coil is discussed below. The direction of a magnetic flux occurring on the internal side of the first coil L1 (upward or downward in the z-axis illustrated in FIG. 1) when a current flows from the external terminal 21*a* through the first coil L1 to the external terminal 21*c* is the same as the direction of a magnetic flux occurring on the internal side of the second coil L2 when a current flows from the external terminal 21*b* through the second coil L2 to the external terminal 21*d*. The coil component 10 may be a transformer, a coil array, or the like. The direction of the magnetic flux occurring in the first coil L1 and that in the second coil L2 may be the same or different.

The second substrate 13 has a substantially rectangular parallelepiped shape. The second substrate 13 may be made of, for example, a non-resin. In the present embodiment, the second substrate 13 is made of a magnetic material. An example material of the second substrate 13 may be the same as the material exemplified in the description on the first substrate 11. The second substrate 13 is bonded to the top surface of the multilayer body 12 with bonding layers 71 and 72 interposed therebetween. One example material of the bonding layers 71 and 72 may be a thermosetting polyimide resin.

The internal configuration of the multilayer body 12 is described in detail below. In the coil component 10, the multilayer body 12 includes the non-photosensitive first resin insulating layers and the photosensitive second resin insulating layers and has a section where the first resin insulating layers and the second resin insulating layers are alternately laminated. Various resin materials, including polyimide resin, epoxy resin, phenol resin, and benzocyclobutene resin, may be used in the first resin insulating layers and the second resin insulating layers.

Specifically, as illustrated in FIG. 2, the multilayer body 12 includes the nine resin insulating layers 31 to 39 laminated in the lamination direction D above the first substrate 11. The resin insulating layers 31, 33, 35, 37, and 39 are the non-photosensitive first resin insulating layers, and the resin insulating layers 32, 34, 36, and 38 are the photosensitive second resin insulating layers. In FIG. 2, for distinguishing the non-photosensitive first resin insulating layers and the photosensitive second resin insulating layers, the non-photosensitive first resin insulating layers are illustrated as being hollow, and the photosensitive second resin insulating layers are illustrated with a dot pattern. In FIG. 2, the dot pattern on the first substrate 11 and the second substrate 13 does not indicate being photosensitive.

Figure 3:
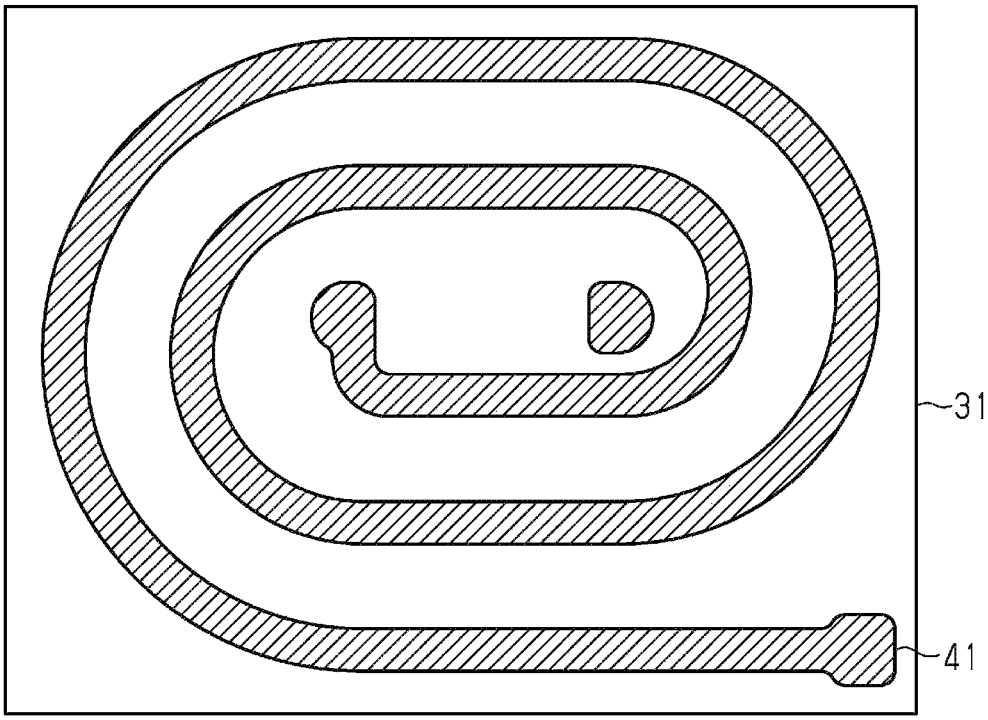
FIG. 3 is a schematic plan view that illustrates a helical shape of a coil conductive layer.

The coil conductive layer 41 is disposed between the upper principal surface of the resin insulating layer 31 and the lower principal surface of the resin insulating layer 32. As illustrated in FIG. 3, for example, the coil conductive layer 41 is wound in a two-dimensional helical (spiral) shape on the upper principal surface (top surface) of the resin insulating layer 31. The coil conductive layer 42 is disposed between the upper principal surface of the resin insulating layer 33 and the lower principal surface of the resin insulating layer 34. Although not illustrated in the drawings, the coil conductive layer 42 has a two-dimensional helical shape on the upper principal surface (top surface) of the resin insulating layer 33, similar to the coil conductive layer 41. The coil conductive layer 43 is disposed between the upper principal surface of the resin insulating layer 35 and the lower principal surface of the resin insulating layer 36. Although not illustrated in the drawings, the coil conductive layer 43 has a two-dimensional helical shape on the upper principal surface (top surface) of the resin insulating layer 35, similar to the coil conductive layer 41. The coil conductive layer 44 is disposed between the upper principal surface of the resin insulating layer 37 and the lower principal surface of the resin insulating layer 38. Although not illustrated in the drawings, the coil conductive layer 44 has a two-dimensional helical shape on the upper principal surface (top surface) of the resin insulating layer 37, similar to the coil conductive layer 41. The resin insulating layer 39 is disposed on the top surface of the resin insulating layer 38.

That is, in the multilayer body 12 according to the present embodiment, the coil conductive layers 41, 42, 43, and 44 are disposed between the upper principal surfaces of the resin insulating layers 31, 33, 35, and 37 and the lower principal surfaces of the resin insulating layers 32, 34, 36, and 38. The resin insulating layers 31, 33, 35, and 37, whose upper principal surfaces are in contact with the coil conductive layers 41, 42, 43, and 44, are the non-photosensitive first resin insulating layers. The resin insulating layers 32, 34, 36, and 38, whose lower principal surfaces are in contact with the coil conductive layers 41, 42, 43, and 44, are the photosensitive second resin insulating layers. Because the coil conductive layers 41, 42, 43, and 44 are disposed on the resin insulating layers 31, 33, 35, and 37, which are the first resin insulating layers, whose expansion and shrinkage caused by heat are relatively small, the precision of forming the coil conductive layers 41, 42, 43, and 44 can be improved.

The via wires 51 and 52 are disposed in the opening portions 32X to 37Y of the resin insulating layers 32 to 37. The opening portions 32X to 37Y of the resin insulating layers 32 to 37 can be formed by an appropriate opening method by employing the difference between photosensitivity and non-photosensitivity of the resin insulating layers 32 to 37. Examples of the method for forming the opening portions 33X, 35X, 35Y, and 37Y of the resin insulating layers 33, 35, and 37, which are the non-photosensitive first resin insulating layers, may include sandblasting processing and laser processing. An example of the method for forming the opening portions 32X, 34X, 34Y, and 36Y of the resin insulating layers 32, 34, and 36, which are the photosensitive second resin insulating layers, may be photolithography.

(Actions)

The multilayer body 12 in the coil component 10 has the section where the resin insulating layers 31, 33, 35, 37, and 39, which are the non-photosensitive first resin insulating layers, and the resin insulating layers 32, 34, 36, and 38, which are the photosensitive second resin insulating layers, are alternately laminated. The coefficient of linear expansion of the non-photosensitive first resin insulating layers is smaller than that of the photosensitive second resin insulating layers. In the coil component 10, because the multilayer body 12 has the section where the photosensitive second resin insulating layers and the non-photosensitive first resin insulating layers, which have the coefficient of linear expansion smaller than that of the photosensitive second resin insulating layers, are alternately laminated, stress in the second resin insulating layers caused by heat load in a production process and a mounting process for the coil component 10, an environment where the coil component 10 is used, or the like can be easily released in portions adjacent to the first resin insulating layers, and the occurrence of internal defects, such as crack(s), in the multilayer body 12 can be suppressed.

The coefficient of linear expansion of the non-photosensitive first resin insulating layers is near that of the metal used in the coil conductive layers 41 to 44 (e.g., copper). One example of the coefficient of linear expansion of the photosensitive second resin insulating layers may be about 30 to about 40, one example of that of the non-photosensitive first resin insulating layers may be about 15 to about 20, and one example of that of the copper is approximately 16.8. Accordingly, because the multilayer body 12 includes the non-photosensitive first resin insulating layers, whose coefficient of linear expansion is near that of the coil conductive layers 41 to 44, the difference from the coefficient of linear expansion of the coil conductive layers 41 to 44 can be smaller than that in a multilayer body using the photosensitive second resin insulating layers alone, and thus the occurrence of stress itself caused by the above-described heat load can be suppressed.

In the coil component 10, because the resin insulating layers 32 and 33 are present between the coil conductive layers 41 and 42, the first resin insulating layer and the second resin insulating layer are alternately laminated. Thus, even from a local viewpoint of between the coil conductive layers 41 and 42, stress in the second resin insulating layer caused by the above-described heat load can be easily released in the portion adjacent to the first resin insulating layer, the occurrence of internal defects, such as crack(s), in the multilayer body 12 can be more suppressed, and the occurrence of breaks in the coil conductive layers 41 and 42 can also be suppressed. In the coil component 10, substantially the same configuration is present between the coil conductive layers 42 and 43 and between the coil conductive layers 43 and 44, and the occurrence of internal defects, such as crack(s), in the multilayer body 12 can be further suppressed.

When each of the first substrate 11 and second substrate 13 is a ferrite sinter, the coefficient of linear expansion of the ferrite constituting each of the first substrate 11 and second substrate 13 is approximately 9.8. Because the resin insulating layers 31 and 39, which are the non-photosensitive first resin insulating layers, are laminated on the top-surface side and bottom-surface side of the multilayer body 12, respectively, the difference in the coefficient of linear expansion between the first substrate 11 and multilayer body 12 and that between the second substrate 13 and multilayer body 12 can be reduced, in comparison with the multilayer body using the photosensitive second resin insulating layers alone. Thus, the occurrence of internal defects, such as separation between the first substrate 11 and multilayer body 12 and between the second substrate 13 and multilayer body 12, can be suppressed.

Whether each of the resin insulating layers 31 to 39 is the non-photosensitive first resin insulating layer or photosensitive second resin insulating layers can be determined from the presence or absence of a photosensitive component in the resin. Specifically, the absence of a photo-functional group, which has photosensitivity, may be ascertained by the use of, for example, the X-ray diffraction method or Fourier transform infrared spectroscopy.

As described above, the present embodiment can provide the advantages below.

(1-1) The coil component 10 includes the multilayer body 12 in which the plurality of resin insulating layers 31 to 39 are laminated and the coil conductive layers 41, 42, 43, and 44 disposed inside the multilayer body 12. The resin insulating layers 31, 33, 35, 37, and 39 are the non-photosensitive first resin insulating layers, whereas the resin insulating layers 32, 34, 36, and 38 are the photosensitive second resin insulating layers. The multilayer body 12 has the section where the non-photosensitive first resin insulating layers and the photosensitive second resin insulating layers are alternately laminated.

The coefficient of linear expansion of the resin insulating layers 31, 33, 35, 37, and 39, which are the non-photosensitive first resin insulating layers, is smaller than that of the resin insulating layers 32, 34, 36, and 38, which are the photosensitive second resin insulating layers. Accordingly, stress in the second resin insulating layers caused by heat curing in a production process for the coil component 10, reflowing in a mounting process therefor, temperature changes in an environment where the coil component 10 is used, or the like can be easily released in the portions adjacent to the first resin insulating layers, and the occurrence of internal defects, such as crack(s), in the multilayer body 12 can be suppressed.

(1-2) The multilayer body 12 includes the resin insulating layers 31, 33, 35, 37, and 39, which are the non-photosensitive first resin insulating layers having the coefficient of linear expansion near that of the coil conductive layers 41, 42, 43, and 44. Thus, in comparison with the multilayer body including the photosensitive second resin insulating layers alone, the difference in the coefficient of linear expansion between the multilayer body 12 and the coil conductive layers 41 to 44 can be reduced, and the occurrence of stress itself caused by the above-described heat load can be suppressed. Accordingly, the occurrence of internal defects, such as crack(s), in the multilayer body 12 can be further suppressed.

(1-3) The multilayer body 12 includes the resin insulating layers 31 and 39, which are the non-photosensitive first resin insulating layers, on the bottom-surface side and the top-surface side of the multilayer body 12, respectively. Accordingly, in comparison with the multilayer body including the photosensitive second resin insulating layers alone, the difference in the coefficient of linear expansion between the multilayer body 12 and first substrate 11 and that between the multilayer body 12 and second substrate 13 can be reduced. Thus, the occurrence of internal defects, such as separation between the multilayer body 12 and first substrate 11 and between the multilayer body 12 and second substrate 13, can be suppressed.

Second Embodiment

A second embodiment is described below.

The second embodiment differs from the first embodiment in the structure of the multilayer body included in the coil component. The external appearance and the like in the second embodiment are substantially the same as those in the first embodiment, the same reference numerals are used for substantially the same elements, and different portions are described with reference to the accompanying drawings.

Figure 5:
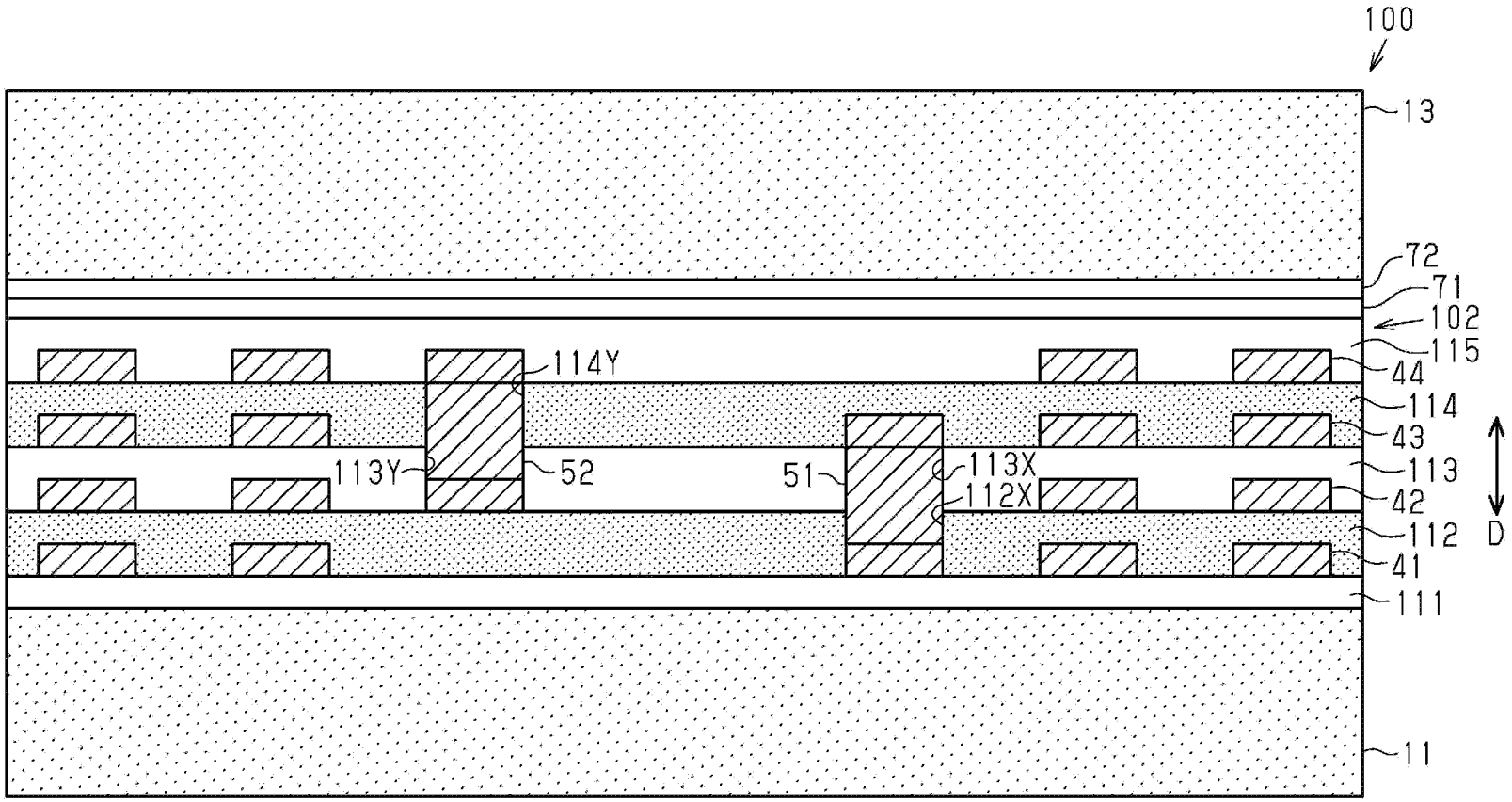
FIG. 5 is a schematic cross-sectional view that illustrates a coil component according to a second embodiment.

FIG. 5 is a schematic cross-sectional view of a coil component 100 according to the second embodiment.

The coil component 100 includes a multilayer body 102 in which a plurality of resin insulating layers 111 to 115 are laminated in the lamination direction D and the coil conductive layers 41 to 44 disposed inside the multilayer body 102 above the first substrate 11. The resin insulating layers 111, 113, and 115 are the non-photosensitive first resin insulating layers, the resin insulating layers 112 and 114 are the photosensitive second resin insulating layers, and the multilayer body 102 has the section where the first resin insulating layers and second resin insulating layers are alternately laminated. In FIG. 5, for distinguishing the non-photosensitive first resin insulating layers and the photosensitive second resin insulating layers in the multilayer body 102, the non-photosensitive first resin insulating layers are illustrated as being hollow, and the photosensitive second resin insulating layers are illustrated with a dot pattern. In FIG. 5, the dot pattern on the first substrate 11 and the second substrate 13 does not indicate being photosensitive.

The coil conductive layer 41 is disposed on the upper principal surface of the resin insulating layer 111 and the lower principal surface of the resin insulating layer 112. The coil conductive layer 42 is disposed between the upper principal surface of the resin insulating layer 112 and the lower principal surface of the resin insulating layer 113. The coil conductive layer 43 is disposed between the upper principal surface of the resin insulating layer 113 and the lower principal surface of the resin insulating layer 114. The coil conductive layer 44 is disposed between the upper principal surface of the resin insulating layer 114 and the lower principal surface of the resin insulating layer 115.

In the multilayer body 102 according to the present embodiment, the resin insulating layers 113 and 115, whose lower principal surfaces are in contact with the coil conductive layers 42 and 44, respectively, are the non-photosensitive first resin insulating layers, and the resin insulating layers 112 and 114, whose upper principal surfaces are in contact with the coil conductive layers 42 and 44, respectively, are the photosensitive second resin insulating layers. The resin insulating layers 113 and 115, whose lower principal surfaces are in contact with the coil conductive layers 42 and 44, respectively, have larger contact areas, in comparison with the insulating layers 112 and 114, whose upper principal surfaces are in contact with the coil conductive layers 42 and 44, respectively, because the resin insulating layers 113 and 115 are also in contact with the side surfaces of the coil conductive layers 42 and 44, respectively. Accordingly, because the resin insulating layers 113 and 115, which have larger contact areas with the coil conductive layers 42 and 44, respectively, are the non-photosensitive first resin insulating layers, which have a coefficient of linear expansion near that of the coil conductive layers 42 and 44, the occurrence of stress itself in the vicinity of the coil conductive layers 42 and 44 can be suppressed.

The via wire 51 is a conductor disposed in an opening portion 112X of the resin insulating layer 112 and an opening portion 113X of the resin insulating layer 113. The via wire 52 is a conductor disposed in an opening portion 113Y of the resin insulating layer 113 and an opening portion 114Y of the resin insulating layer 114. The opening portions 112X, 113X, 113Y, and 114Y of the resin insulating layers 112, 113, and 114 can be formed in substantially the same way as that in the above-described first embodiment.

As described above, the present embodiment can provide the advantages below.

(2-1) The coil component 100 includes the multilayer body 102 in which the plurality of resin insulating layers 111 to 115 are laminated and the coil conductive layers 41 to 44 disposed inside the multilayer body 102. The resin insulating layers 111, 113, and 115 are the non-photosensitive first resin insulating layers, whereas the resin insulating layers 112 and 114 are the photosensitive second resin insulating layers. The multilayer body 102 has the section where the non-photosensitive first resin insulating layers and the photosensitive second resin insulating layers are alternately laminated. Accordingly, stress in the second resin insulating layers caused by heat curing in a production process for the coil component 100, reflowing in a mounting process therefor, temperature changes in an environment where the coil component 100 is used, or the like can be easily released in the portions adjacent to the first resin insulating layers, and the occurrence of internal defects, such as crack(s), in the multilayer body 102 can be suppressed.

(2-2) The multilayer body 102 includes the non-photosensitive first resin insulating layers having the coefficient of linear expansion near that of the coil conductive layers 41 to 44. Thus, in comparison with the multilayer body including the photosensitive second resin insulating layers alone, the difference from the coefficient of linear expansion of the coil conductive layers 41 to 44 in the multilayer body 102 can be reduced, and the occurrence of stress itself caused by the above-described heat load can be suppressed. Accordingly, the occurrence of internal defects, such as crack(s), in the multilayer body 102 can be further suppressed.

(2-3) The multilayer body 102 has the structure in which the resin insulating layers 111 to 115 are laminated. Consequently, the multilayer body 102 can be formed with a smaller number of layers laminated, and the production cost and the manufacturing manhours can be reduced.

Variations

The above-described embodiments may be applied to forms described below.

In the above-described embodiments, the coil components 10 and 100 include the two coils L1 and L2. The number of coils included in the coil component may be one or three or more.

Figure 6:
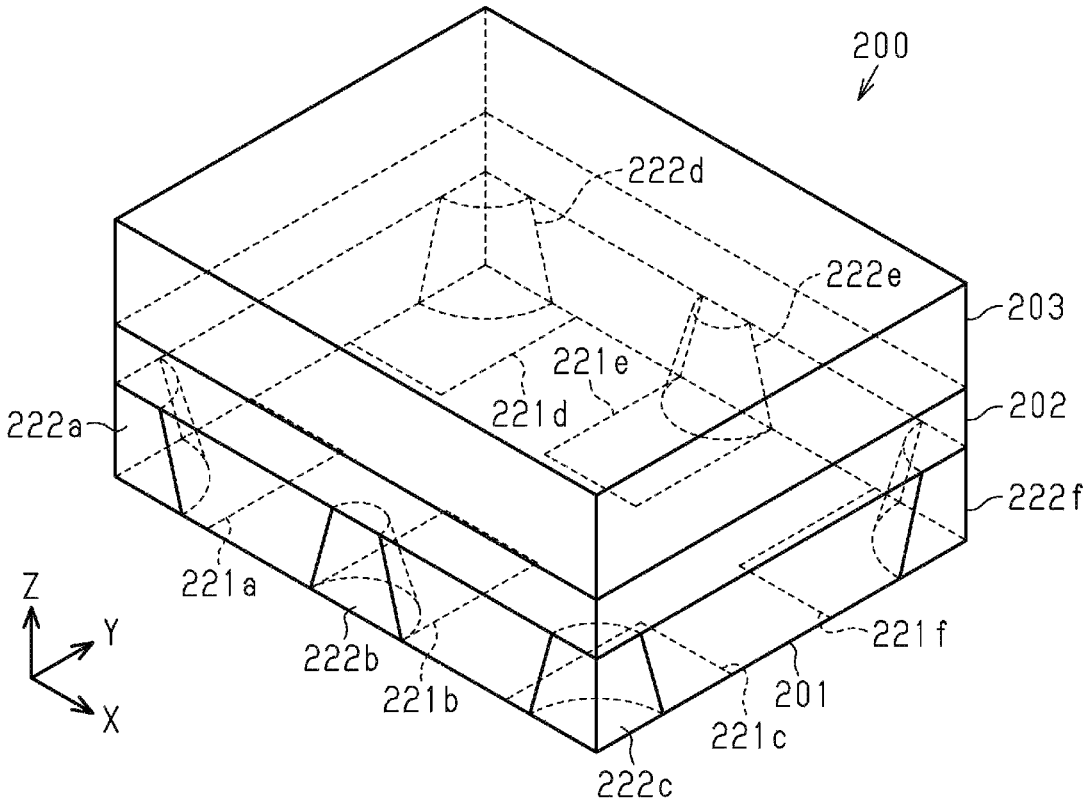
FIG. 6 is a schematic perspective view that illustrates an external appearance of a coil component according to a variation.
Figure 7:
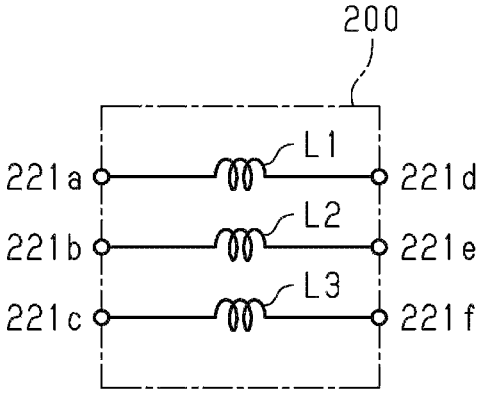
FIG. 7 is a circuit diagram of the coil component according to the variation.

A coil component 200 illustrated in FIGS. 6 and 7 is a coil component including three coils L1, L2, and L3. The coil component 200 includes a multilayer body 202, a first substrate 201 and a second substrate 203 between which the multilayer body 202 is disposed, external terminals 221*a* to 221*f*, and connection members 222*a* to 222*f*.

The external terminals 221*a* to 221*c* are disposed on both end portions and a central portion of one longer side of the bottom surface of the first substrate 201. The external terminals 221*d* to 221*f* are disposed on both end portions and a central portion of the other longer side of the bottom surface of the first substrate 201. The external terminals 221*a* to 221*f* are connected by soldering or the like to a mounting substrate on which the coil component 200 is mounted.

As illustrated in FIG. 7, the first coil L1 is connected between the external terminals 221*a* and 221*d*, the second coil L2 is connected between the external terminals 221*b* and 221*e*, and the third coil L3 is connected between the external terminals 221*c* and 221*f*. In this coil component 200, similar to the multilayer bodies 12 and 102 in the above-described embodiments, the multilayer body 202 has the section where the non-photosensitive first resin insulating layers and the photosensitive second resin insulating layers are alternately laminated, and thus the occurrence of internal defects in the multilayer body 202 can be suppressed.

In the above-described embodiments, the photosensitivity and non-photosensitivity of the resin insulating layers may be changed such that the multilayer body includes the section where the non-photosensitive first resin insulating layers and the photosensitive second resin insulating layers are alternately laminated. For example, in the first embodiment, the resin insulating layers 32, 34, 36, and 38, whose lower principal surfaces are in contact with the coil conductive layers 41, 42, 43, and 44, respectively, may be the non-photosensitive first resin insulating layers, and the resin insulating layers 31, 33, 35, and 37, whose upper principal surfaces are in contact with the coil conductive layers 41, 42, 43, and 44, respectively, may be the photosensitive second resin insulating layers. The resin insulating layer 39 may be the non-photosensitive first resin insulating layer or the photosensitive second resin insulating layer. In the second embodiment, the resin insulating layers 111, 113, and 115 may be the photosensitive second resin insulating layers, and the resin insulating layers 112 and 114 may be the non-photosensitive first resin insulating layers. In the above-described embodiments and variations, the number of the non-photosensitive first resin insulating layers and the number of the photosensitive second resin insulating layers included in the multilayer body may be changed as appropriate.

The multilayer body has the "section" where the first resin insulating layers and the second resin insulating layers are alternately laminated. The first resin insulating layers and the second resin insulating layers may not be alternately laminated in some of the regions where the resin insulating layers are laminated in the multilayer body. For example, two or more first resin insulating layers or two or more second resin insulating layers may be laminated in sequence in the vicinity of the bonding layers 71 and 72. The expression " . . . has the section where . . . are alternately laminated" means that at least one of a three-layer section where the first resin insulating layer, second resin insulating layer, and first resin insulating layer are laminated in this order and a three-layer section where the second resin insulating layer, first resin insulating layer, and second resin insulating layer are laminated in this order exists in the multilayer body. The multilayer body may have the plurality of three-layer sections described above located discretely.

In the above-described embodiments, the coil component includes the coil conductive layers having a two-dimensional helical shape. The coil component may include other types of coil conductive layers. For example, the coil component may include a coil conductive layer that has a three-dimensional linear shape extending spirally in the lamination direction D (helical shape) or may include a coil conductive layer that has a coil of one or less turn disposed between the principal surfaces of the resin insulating layers laminated.

In the above-described embodiments, the bonding layers 71 and 72 may be non-photosensitive or photosensitive. In terms of reduction in the difference from the coefficient of linear expansion of the first substrate 11 and the second substrate 13, the bonding layers 71 and 72 may preferably be non-photosensitive. In terms of reduction in the difference from the coefficient of linear expansion of the multilayer body, the bonding layers 71 and 72 may preferably be photosensitive.

In the above-described embodiments and variations, the number of turns of each of the coil conductive layers may be smaller than one.

In the above-described embodiments and variations, the thickness of the coil conductive layer may be changed as appropriate.

In the above-described embodiments and variations, the second substrate 13 may be omitted.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a multilayer body in which a plurality of resin insulating layers including a non-photosensitive first resin insulating layer and a photosensitive second resin insulating layer are laminated in a lamination direction, the multilayer body has a section where the non-photosensitive first resin insulating layer and the photosensitive second resin insulating layer are alternately laminated;

a first coil conductive layer disposed inside the multilayer body; and a substrate arranged on one surface of the multilayer body in the lamination direction and made of a non-resin.

2. The coil component according to claim 1, wherein the non-photosensitive first resin insulating layer has a coefficient of linear expansion smaller than that of the photosensitive second resin insulating layer.

3. The coil component according to claim 1, wherein the first coil conductive layer is disposed between principal surfaces of the plurality of resin insulating layers.

4. The coil component according to claim 3, wherein the non-photosensitive first resin insulating layer has a lower principal surface being in contact with the first coil conductive layer, and the photosensitive second resin insulating layer has an upper principal surface being in contact with the first coil conductive layer.

5. The coil component according to claim 3, wherein the photosensitive second resin insulating layer has a lower principal surface being in contact with the first coil conductive layer, and the non-photosensitive first resin insulating layer has an upper principal surface being in contact with the first coil conductive layer.

6. The coil component according to claim 1, further comprising a second coil conductive layer disposed above the first coil conductive layer, and wherein the non-photosensitive first resin insulating layer and the photosensitive second resin insulating layer are alternately laminated between the first coil conductive layer and the second coil conductive layer.

7. The coil component according to claim 1, wherein the substrate is made of a magnetic material.

8. The coil component according to claim 1, further comprising a bonding layer for bonding the multilayer body and the substrate.

9. The coil component according to claim 2, wherein the first coil conductive layer is disposed between principal surfaces of the plurality of resin insulating layers.

10. The coil component according to claim 2, further comprising a second coil conductive layer disposed above the first coil conductive layer, and wherein the non-photosensitive first resin insulating layer and the photosensitive second resin insulating layer are alternately laminated between the first coil conductive layer and the second coil conductive layer.

11. The coil component according to claim 3, further comprising a second coil conductive layer disposed above the first coil conductive layer, and wherein the non-photosensitive first resin insulating layer and the photosensitive second resin insulating layer are alternately laminated between the first coil conductive layer and the second coil conductive layer.

12. The coil component according to claim 4, further comprising a second coil conductive layer disposed above the first coil conductive layer, and wherein the non-photosensitive first resin insulating layer and the photosensitive second resin insulating layer are alternately laminated between the first coil conductive layer and the second coil conductive layer.

13. A coil component comprising:

a multilayer body in which a plurality of resin insulating layers including a non-photosensitive first resin insulating layer and a photosensitive second resin insulating layer are laminated in a lamination direction, the multilayer body has a section where the non-photosensitive first resin insulating layer and the photosensitive second resin insulating layer are alternately laminated;

a first coil conductive layer disposed inside the multilayer body, and a pair of substrates arranged on opposite surfaces of the multilayer body in the lamination direction, wherein each of the substrates is made of a non-resin.

14. The coil component according to claim 13, wherein the non-photosensitive first resin insulating layer has a coefficient of linear expansion smaller than that of the photosensitive second resin insulating layer.

15. The coil component according to claim 13, wherein the substrate is made of a magnetic material.

16. The coil component according to claim 13, further comprising a bonding layer for bonding the multilayer body and the substrate.

17. A coil component comprising:

a multilayer body in which a plurality of resin insulating layers including a first resin insulating layer and a second resin insulating layer having a coefficient of linear expansion larger than that of the first resin insulating layer are laminated in a lamination direction, the multilayer body has a section where the first resin insulating layer and the second resin insulating layer are alternately laminated;

a first coil conductive layer disposed inside the multilayer body; and a substrate arranged on one surface of the multilayer body in the lamination direction and made of a non-resin.

* * * * *